US005623832A

United States Patent [19]

Bokitch et al.

[11] Patent Number: 5,623,832

[45] Date of Patent: Apr. 29, 1997

[54] EXTRACTION AND STORAGE OF PRESSURIZED FLUENT MATERIALS

[76] Inventors: Dennis J. Bokitch, 191 Elmview Road, Regina, Saskatchewan, Canada, S4R 6B5; William E. Hastings, 195 Lloyd Crescent, Regina, Saskatchewan, Canada, S4R 6C2

[21] Appl. No.: 325,669

[22] Filed: Oct. 19, 1994

Related U.S. Application Data

[63] Continuation-in-part of Ser. No. 138,442, Oct. 20, 1993, abandoned.

[51] Int. Cl.[6] ..... F25B 45/00

[52] U.S. Cl. ..... 62/77; 62/50.2; 62/292; 165/169

[58] Field of Search ..... 62/165, 388, 77, 62/85, 292, 475, 52.2; 165/169

[56] References Cited

U.S. PATENT DOCUMENTS 5,101,637 4/1992 Daily ..... 62/50.2

5,189,881 3/1993 Miles ..... 62/77

*Primary Examiner*—John M. Sollecito

*Attorney, Agent, or Firm*—Adrian D. Battison; Murray E. Thrift

[57] ABSTRACT

Extraction of a fluent material from a pressurized system containing same such as CFC for reclamation is effected into a container by reducing the temperature of the container to a sufficiently cold temperature to generate a vacuum within the container sufficient to extract the CFC from the system to be extracted. The container is cooled by placing the container into an insulated drum containing a glycol bath within which is provided an evaporator duct shaped with a plurality of separate duct portions lying in horizontal planes and spaced vertically with each portion interconnected to the next by a vertical section of the duct. Into the duct is injected carbon dioxide from a compressed liquid supply which is passed through a metering orifice tuned to the length and shape of the duct so that evaporation takes place by the end of the duct. Any liquid remaining at the end of the duct as the temperature cools is returned by a diverter valve into the gylcol bath for additional cooling effect.

20 Claims, 2 Drawing Sheets

EXTRACTION AND STORAGE OF PRESSURIZED FLUENT MATERIALS

This is a Continuation-in-Part application of application Ser. No: 138,442 filed Oct. 20th, 1993 , which is now abandoned.

BACKGROUND OF THE INVENTION

This invention relates to an apparatus and method for extraction and collection of pressurized fluent materials from a system containing same such as CFC gases. Such pressurized materials can include gases, liquids and even flowable or fluent powders all of which are of the type received or contained within a pressurized system from which it is necessary to extract the material into a secure location.

The discovery of the damaging effects of CFC, of which Freon is one example, has led to many developments to overcome the problems of escape of the freon into the atmosphere.

Various techniques have been proposed for extraction of freon from freon containing systems to prevent the freon from accessing the atmosphere.

Most systems require a pump which necessitates the provision of electrical power and in many circumstances this is not available.

Another technique very recently exposed is called the "blue bottle" system which provides a container including a sponge like material known as a "zeolite matrix" which is stated to trap the CFC molecules. The effectiveness of this technique is not known.

Another technique which has been proposed is that of providing a container which is sealed. The container is then wrapped with a bag to cool the container so as to reduce the pressure in gas within the container thus generating a partial vacuum to draw the CFCs from the system. This technique has been effectively abandoned and has received very poor response in the field as it is highly inefficient and effectively technically valueless.

SUMMARY OF THE INVENTION

It is one object of the present invention, therefore, to provide an improved technique for extraction and collection of a fluent material from a pressurized system containing same.

According to the first aspect of the invention there is provided a method for extraction and collection of a fluent material from a pressurized system containing same comprising providing a sealed storage container containing gas substantially at atmospheric pressure, placing the sealed storage container in an insulated drum, immersing the container within a coolant medium inside the drum such that the coolant medium intimately engages an outside surface of the container, providing an evaporator duct in the drum within the coolant medium surrounding the container, providing a supply of compressed $CO_2$ in liquid form in a supply vessel, passing the $CO_2$ through the duct from the supply vessel to an end of the duct to cool the medium and the container and thus to reduce the pressure of the gas in the container to generate a partial vacuum, connecting the container to the system and communicating the partial vacuum to the system to extract the material and including the steps of shaping the duct to include a plurality of duct portions each separated from the next by at least a one hundred eighty degree turn, providing an orifice between the supply vessel and the duct through which the $CO_2$ passes, and tuning a dimension of the orifice relative to a length and diameter of the duct such that by the end of the duct substantially all of the $CO_2$ in liquid form has evaporated to gas for discharge to atmosphere.

According to the second aspect of the invention there is provided an apparatus for extraction and collection of a fluent material from a pressurized system containing same comprising a plurality of sealed storage containers, an insulated drum, the drum defining an opening for receiving a selected one of the containers, each of the containers being insertable into and removable from the opening, the drum containing a liquid coolant medium arranged to intermittently engage an outside surface of the container and an evaporator duct within the drum in engagement with the coolant medium, the duct being shaped to include a plurality of duct portions each separated from the next by at least a right angle turn, a supply vessel of compressed $CO_2$ in liquid form, means for connecting the duct to said supply vessel of $CO_2$ and means for connecting the container within the drum to the system, a metering orifice between the supply vessel and the duct through which the $CO_2$ passes, and a diverter valve at the end of the duct actuable to direct any $CO_2$ in liquid form at said end of the duct from said end of the duct into said medium in said drum to effect further cooling of said medium.

According to a third aspect of the invention there is provided a method for extraction and collection of a fluent material from a pressurized system containing same comprising providing a sealed storage container containing gas substantially at atmospheric pressure, placing the sealed storage container in an insulated drum, immersing the container within a coolant medium inside the drum such that the coolant medium intimately engages an outside surface of the container, providing an evaporator duct in the drum within the coolant medium surrounding the container, providing a supply of compressed $CO_2$ in liquid form in a supply vessel, passing the $CO_2$ through the duct from the supply vessel to an end of the duct to cool the medium and the container and thus to reduce the pressure of the gas in the container to generate a partial vacuum, connecting the container to the system and communicating the partial vacuum to the to extract the material, providing a metering orifice between the supply vessel and the duct through which the $CO_2$ passes, tuning a dimension of the orifice relative to a length and diameter of the duct such that, at an initial temperature of the container, on reaching the end of the duct substantially all of the $CO_2$ in liquid form has evaporated to gas for discharge, and providing a diverter valve at the end of the duct arranged to direct any $CO_2$ in liquid form at said end of the duct into said medium in said drum to effect further cooling of said medium, and actuating said diverter valve when a decrease in the temperature of the container causes some of the $CO_2$ at the end of the duct to remain in liquid form.

One embodiment of the invention will now be described in conjunction with accompanying drawings in which:

DETAILED DESCRIPTION

Figure 1:
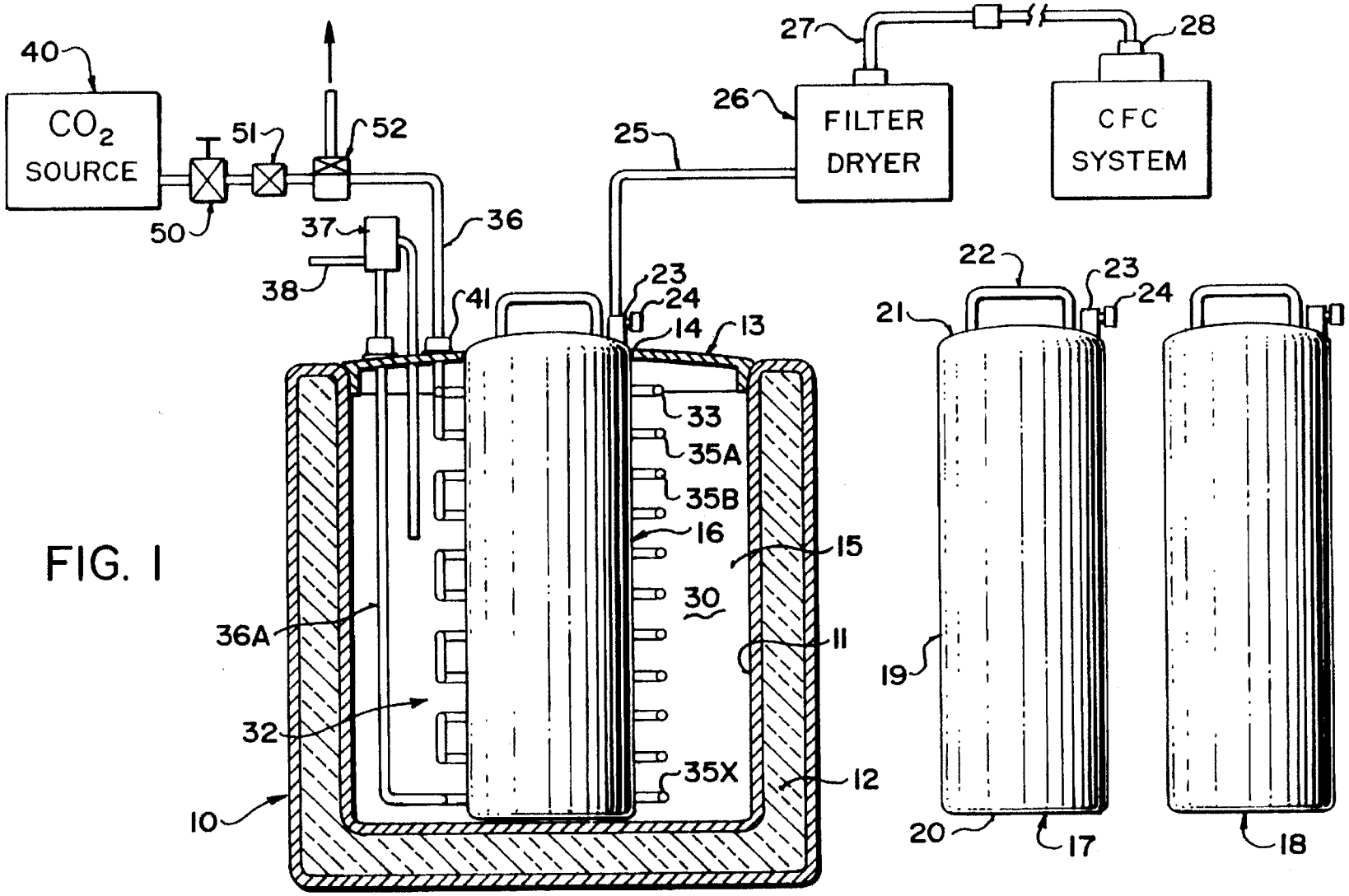
FIG. 1 is a schematic illustration of the apparatus and method of the present invention showing drum and container in vertical cross-sectional view.
Figure 2:
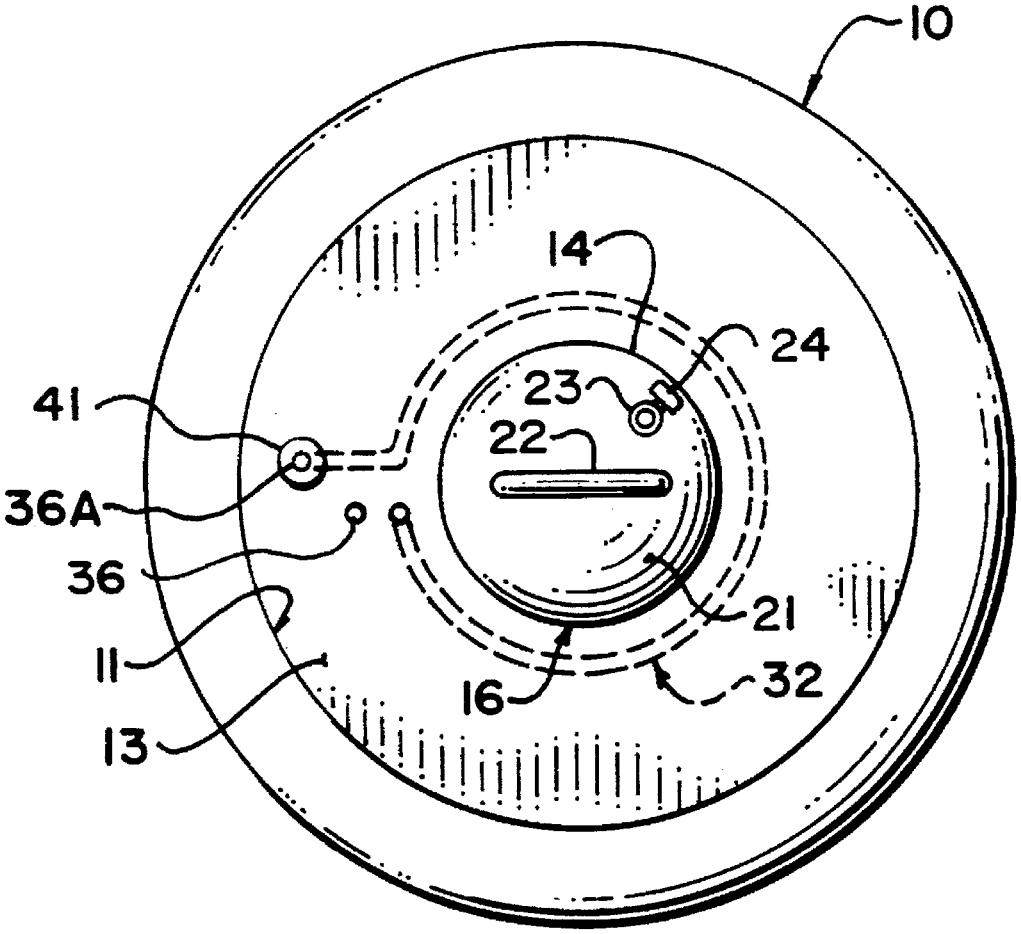
FIG. 2 is a top plan view of the drum and container of FIG. 1.

The apparatus comprises a main drum 10 having an inner wall 11 defining a cylindrical interior. The outside surface of the inner wall 11 is covered with insulation material 12 of a conventional nature providing a high level of insulation to accommodate temperatures as low as minus two hundred degrees Celsius.

The drum includes a cover panel 13 which extends over the drum and over a part of the hollow interior and includes a central opening 14. The central opening is of smaller diameter than the inner wall 11 so as to define a hollow interior 15 surrounding an imaginary cylinder containing the circular opening 14.

The system further includes a plurality of separate containers 16, 17, 18 each for receiving a different grade of CFC. Each container 16, 17, 18 comprises an outer cylindrical wall 19, a horizontal base 20 and a top wall 21. Attached to top wall 21 is a handle 22 standing up from the top wall which can be manually grasped for vertical lifting of the container. On the top walls is also provided an inlet 23 of the quick coupling type with a valve 24 which can be manually operated to open access from the coupling to the interior of the container. The coupling is shown schematically but is arranged for attachment to a convention pipe 25 extending from the coupling 23 to a filter/dryer system indicated at 26 all forming part of the system. From the filter/dryer system is provided a further coupling hose 27 which extends to a connector 28.

The diameter of the cylindrical wall 19 of each container is substantially equal to the diameter of the opening 14 so that the container can slide into the outer drum through the circular opening with the inside of the circular opening sweeping against the surface of the cylindrical container.

Within the cylindrical container is provided a coolant medium of a character for communicating heat so that the material has a high thermal conductivity. One example of the material of this type is glycol and this material is indicated schematically at 30. The coolant medium substantially fills the annular space between the outside of the container 16 and the inside wall 11 so it is intimately in contact with the outside wall of the container.

Within the container is provided a evaporator duct 32 which is wrapped around the outer wall of the container 16 and is spaced therefrom so as to allow the coolant medium to sit between the inside of the duct and the outside of the container. The duct is wrapped so as to lie on a cylinder of a diameter slightly larger than that of the cylindrical surface 16. The duct is wrapped so the first leg 36 extends through the cover 13 to the top of the drum 11 and then forms a first circle 33 lying in a first horizontal plane adjacent the top of the drum. After one turn of 360°, the pipe is bent vertically downwardly and it is bent again to form a second circle lying in a horizontal plane spaced downwardly from the first circle. The pipe then bends repeatedly to form a series of circles each extending around 360°. Each circle rotates in a direction opposite to that of the previous circle. The circles are shown at 35A, 35B, etc.

A $CO_2$ source in a supply vessel 40 is connected to the first leg 36 by a connector 41. The $CO_2$ source is provided by a conventional gas cylinder of the type which is readily available for various purposes and contains compressed $CO_2$ in liquid form. An end of the pipe from the lowermost circle 35X extends through the cover 13 and connects to a valve 37 which acts as a bypass valve or diverter valve for returning any $CO_2$ in liquid form remaining at the end of the duct into the medium 30 through a return line 37A. The evaporated $CO_2$ gas is allowed to release through a vent 38. The $CO_2$ source 40 includes a control valve 50 manually operable to release $CO_2$ in compressed liquid form into the system. Downstream of the valve 50 is provided a metering device 51 including a metering orifice. The metering orifice is tuned relative to the pipe size and the length of the pipe in the evaporator so that, at an initial temperature of the system, the liquid $CO_2$ all evaporates to form gas to be released at the end of the evaporator at the valve 37. In one example, the use of a pipe of one quarter inch diameter is associated with a metering orifice known as an 80 orifice to tune the system to obtain best efficiency.

The tuning is effected by selection of the orifice diameter so that, at ambient temperature, the material passing through the evaporator consists of basically a saturated vapour which carries some liquid in mist or fine droplet form. The tuning is effected so that the material is in this saturated vapour form all the way to substantially the outlet or discharge end of the duct. In this way the material within the evaporator contains along its full length some liquid in the mist or fine droplet form and this liquid assists in the transfer of heat and of course generates the majority of the heat transfer by the evaporation of the liquid. The tuning is effected therefore so that the complete evaporation does not occur at an earlier point in the evaporator duct since downstream of the complete evaporation there would be passing merely gas which has a significantly reduced heat transfer effect relative to the saturated vapour. In addition the tuning is effected so that the evaporation of the liquid to gas does not occur at a sufficiently rapid rate to cause any substantial freezing of the liquid which could otherwise cause blockages in the duct To obtain an enhanced effect, the saturated vapour is supplied to the top turn of the evaporator duct so that the maximum cooling effect is achieved in the top turn with the cooling effect gradually decreasing downwardly through the further turns of the evaporator duct. This orientation combines with the convection currents within the coolant medium to obtain maximum efficiency.

As the temperature of the system including the container decreases, less heat is transferred to the evaporator from the glycol medium so that not all of the liquid is evaporated to gas so that some of the $CO_2$ remains in liquid form. Thus any liquid remaining in the system at the valve 37 is injected into the coolant medium to complete evaporation. Downstream of the metering device 51 is provided a safety valve 52 acting as a pressure relief to atmosphere in the event of an over pressure in the system. In an alternative arrangement (not shown), the bottom ones 33 of the turns of pipe 32 can be arranged in a space between the bottom of the tank 16 and the upper surface of the bottom of the container 11.

In operation, the apparatus is transported in a suitable transport vehicle including the drum 10 and the containers 16, 17, and 18. These are brought to the required site at which is located the CFC system to be extracted. After determining the grade of CFC to be extracted, a first volume of the CFC can be extracted using the conventional pump in the CFC system if that pump is operational. This leaves a residue of the CFC which cannot be extracted. In other cases where the pump is not operational, the whole of the CFC can be extracted by the present apparatus.

The required container 16, 17 or 18 for the grade of CFC is selected and inserted through the opening 14 into the drum. The upper surface 21 of the container is presented just above the opening 14 so that the connector 23 is accessible. The filter/dryer 26 is then connected by the pipe 25 to the connector 23. The $CO_2$ source 40 is connected to the connector 41 and the $CO_2$ is released through the pipe to the valve 37 and the vent 38. The evaporation of the gas from the liquid source 40 thus causes rapid cooling of the pipe and the coolant medium surrounding the pipe. In view of the high conductivity of the coolant medium, the cool generated in the pipe is communicated efficiently to the outside surface of the container 16 thus rapidly cooling the outside surface and cooling the gas inside the container. This causes rapid contraction of the gas within the container which generates a vacuum within the container as the valve 24 is closed preventing further gas from entering the container. At this time the pipe 27 is connected by the connector 28 to the outlet of the CFC system and the valve 24 is opened so that the vacuum generated within the container acts to extract the remaining CFC within the CFC system.

When the extraction is completed, the valve 24 is closed, thus fully containing the CFC within the container and preventing its release to the atmosphere. The container 16 is then removed from the outer drum and this causes the outside wall of the container to sweep or wipe the liquid coolant medium from the outside surface of the container as it is removed.

A separate lid (not known) can be provided to be mounted over the opening 14 extending simply across the opening or across the whole of the upper surface of the drum.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A method for extraction and collection of a fluent material from a pressurized system containing same comprising providing a sealed storage container containing gas substantially at atmospheric pressure, placing the sealed storage container in an insulated drum, immersing the container within a coolant medium inside the drum such that the coolant medium intimately engages an outside surface of the container, providing an evaporator duct in the drum within the coolant medium surrounding the container, providing a supply of compressed $CO_2$ in liquid form in a supply vessel, passing the $CO_2$ through the duct from the supply vessel to an end of the duct to cool the medium and the container and thus to reduce the pressure of the gas in the container to generate a partial vacuum, connecting the container to the system and communicating the partial vacuum to the system to extract the material and including the steps of shaping the duct to include a plurality of duct portions each separated from the next by at least a one hundred eighty degree turn, providing an orifice between the supply vessel and the duct through which the $CO_2$ passes, and tuning a dimension of the orifice relative to a length and diameter of the duct such that by the end of the duct substantially all of the $CO_2$ in liquid form has evaporated to gas for discharge to atmosphere.

2. The method according to claim 1 including removing the container from the drum for storage of the material.

3. The method according to claim 1 including providing a wiper mounted on the drum at an open top thereof and arranging the wiper such that the act of extraction of the container from the drum automatically effects wiping the container as it is extracted from the drum to remove the coolant medium.

4. The method according to claim 1 including providing a plurality of separate containers each insertable within and removable from the drum and arranging the containers for extracting and storing different grades of material.

5. The method according to claim 1 wherein the coolant medium is glycol.

6. The method according to claim 1 including providing a diverter means at the end of the duct and actuating said valve to direct any $CO_2$ in liquid form at said end of the duct from said end of the duct into said medium in said drum to effect further cooling of said medium.

7. The method according to claim 1 including shaping the duct such that each of said portions comprises a substantially horizontal circle of duct with the portions arranged in vertically spaced relation coaxially around a vertical axis, each portion is connected to the next portion by a vertical duct portion and the portions are directed in alternate directions around said axis.

8. The method according to claim 1 wherein the orifice is tuned such that the $CO_2$ in the evaporator duct includes at least a proportion of liquid substantially to the end of the duct.

9. The method according to claim 1 wherein orifice is tuned such that the $CO_2$ in the evaporator duct is in saturated vapour form.

10. The method according to claim 7 wherein duct is arranged such that the supply vessel is connected to the uppermost portion of the duct.

11. The method according to claim 1 wherein the orifice is tuned to substantially prevent freezing of the liquid in the duct.

12. An apparatus for extraction and collection of a fluent material from a pressurized system containing same comprising a plurality of sealed storage containers, an insulated drum, the drum defining an opening for receiving a selected one of the containers, each of the containers being insertable into and removable from the opening, the drum containing a liquid coolant medium arranged to intermittently engage an outside surface of the container and an evaporator duct within the drum in engagement with the coolant medium, the duct being shaped to include a plurality of duct portions each separated from the next by at least a right angle turn, a supply vessel of compressed $CO_2$ in liquid form, means for connecting the duct to said supply vessel of $CO_2$ and means for connecting the container within the drum to the system, a metering orifice between the supply vessel and the duct through which the $CO_2$ passes, and a diverter valve at the end of the duct actuable to direct any $CO_2$ in liquid form at said end of the duct from said end of the duct into said medium in said drum to effect further cooling of said medium.

13. The apparatus according to claim 12 including a wiper carried on the drum at an open top thereof and arranged for wiping the container as it is extracted from the drum such that the act of extraction of the container from the drum automatically effects wiping the container to remove the coolant medium.

14. The apparatus according to claim 12 wherein the duct is shaped such that each of said portions comprises a substantially horizontal circle of duct with the portions arranged in vertically spaced relation coaxially around a vertical axis, and wherein each portion is connected to the next portion by a vertical duct portion and the portions are directed in alternate directions around said axis.

15. A method for extraction and collection of a figment material from a pressurized system containing same comprising providing a sealed storage container containing gas substantially at atmospheric pressure, placing the sealed storage container in an insulated drum, immersing the container within a coolant medium inside the drum such that the coolant medium intimately engages an outside surface of the container, providing an evaporator duct in the drum within the coolant medium surrounding the container, providing a supply of compressed $CO_2$ in liquid form in a supply vessel, passing the $CO_2$ through the duct from the supply vessel to an end of the duct to cool the medium and the container and thus to reduce the pressure of the gas in the container to generate a partial vacuum, connecting the container to the system and communicating the partial vacuum to the to extract the material, providing a metering orifice between the supply vessel and the duct through which the $CO_2$ passes, tuning a dimension of the orifice relative to a length and diameter of the duct such that, at an initial temperature of the container, on reaching the end of the duct substantially all of the $CO_2$ in liquid form has evaporated to gas for discharge, and providing a diverter valve at the end of the duct arranged to direct any $CO_2$ in liquid form at said end of the duct into said medium in said drum to effect further cooling of said medium, and actuating said diverter valve when a decrease in the temperature of the container causes some of the $CO_2$ at the end of the duct to remain in liquid form.

16. The method according to claim 15 including shaping the duct such that each of said portions comprises a substantially horizontal circle of duct with the portions arranged in vertically spaced relation coaxially around a vertical axis, each portion is connected to the next portion by a vertical duct portion and the portions are directed in alternate directions around said axis.

17. The method according to claim 15 wherein the orifice is tuned such that the $CO_2$ in the evaporator duct includes at least a proportion of liquid substantially to the end of the duct.

18. The method according to claim 15 wherein orifice is tuned such that the $CO_2$ in the evaporator duct is in saturated vapour form.

19. The method according to claim 16 wherein the duct is arranged such that the supply vessel is connected to the uppermost portion of the duct.

20. The method according to claim 15 wherein the orifice is tuned to substantially prevent freezing of the liquid in the duct.

* * * * *